US005555930A

United States Patent [19]

Lu

[11] Patent Number: 5,555,930

[45] Date of Patent: Sep. 17, 1996

[54] HEAT EXCHANGER ASSEMBLY WITH STRUCTURAL SIDE PASSAGEWAYS

[75] Inventor: James W. B. Lu, Mt. Pleasant, S.C.

[73] Assignee: Behr Heat Transfer, Inc., Charleston, S.C.

[21] Appl. No.: 267,032

[22] Filed: Jun. 24, 1994

[51] Int. Cl.[6] ..... F28D 1/00; F28F 7/00

[52] U.S. Cl. ..... 165/81; 165/149

[58] Field of Search ..... 165/67, 81, 82, 165/149

[56] References Cited

U.S. PATENT DOCUMENTS

| | | | |
|---|---|---|---|
| 2,164,605 | 7/1939 | Young | 165/81 X |
| 3,034,770 | 5/1962 | Hiersch | 165/153 X |
| 4,791,982 | 12/1988 | Meyerhofer | 165/148 X |
| 5,257,662 | 11/1993 | Osborn | 165/173 |

FOREIGN PATENT DOCUMENTS

| | | | |
|---|---|---|---|
| 4120869 | 1/1993 | Germany | 165/149 |
| 658391 | 4/1979 | U.S.S.R. | 165/81 |

*Primary Examiner*—Leonard R. Leo
*Attorney, Agent, or Firm*—Howard & Howard

[57] ABSTRACT

A heat exchanger (10) includes a pair of spaced manifolds (12, 14) with a plurality of fluid tubes (16) extending therebetween in fluid communication. Fins (18) are connected between the fluid tubes (16) for enhancing heat exchanger with air passed thereover. Side support members (22) are connected between the ends of the manifolds (12, 14) to provide support of the fluid tubes (16) and fins (18) between the manifolds (12, 14). The side support members (22) include passageways (40) therethrough in a fluid communication with the manifolds (12, 14) to allow fluid to freely pass therethrough with the fluid passing through the fluid tubes (16) to thermally effect both members in a similar manner.

1 Claim, 2 Drawing Sheets

HEAT EXCHANGER ASSEMBLY WITH STRUCTURAL SIDE PASSAGEWAYS

TECHNICAL FIELD

The subject invention relates to heat exchangers of the type having a pair of manifolds with a core member connected therebetween, the core including a plurality fluid tubes and fins with outer, structural side support members extending between the manifolds.

BACKGROUND OF THE INVENTION

Commonly known in the art are heat exchangers used in connection with an automotive vehicle for cooling the engine of the vehicle. The heat exchanger generally comprises upper and lower manifolds providing fluid reservoirs and a plurality of coolant or fluid tubes extending between the manifolds providing fluid communication therebetween.

Liquid coolant may pass through the upper and lower manifolds in a liquid to air heat exchanger because liquid passes through the tanks and tubes while air is passed external and between the tubes for cooling the fluid contained therein.

There are also air to air heat exchangers wherein air is passed within the tubes and air is passed externally thereover for heat exchange. This type of heat exchanger may be used in turbo charged engines wherein heat exchangers are routinely used for cooling compressed "charged" air from a turbo charger on route to the cylinders for combustion.

The components of the heat exchanger are generally welded or soldered together. The core, comprising the fluid tubes, fins and side support members, receives ambient cooling air passing through and around the cooling fins and is disbursed about the cooling tubes, thereby allowing the fluid to release the majority of its thermal energy. The high amount of energy released causes large thermal expansion of the coolant tubes, cooling fins and header. However, the side support members are generally at a lower temperature since the heated fluid does not flow directly therethrough. This large thermal expansion of part of the core causes stresses between the tanks and fluid tubes and side members. Significant stresses caused from the differences in the thermal expansion of the members over time can cause cracking and fatigue between the joints. This may result in leaks, lost pressure, and the engine lost horsepower output. It is therefore desirable to reduce stresses while allowing normal expansion to continue.

U.S. Pat. No. 5,257,662, issued Nov. 2, 1993 in the name of Osborn illustrates a typical heat exchanger assembly including a pair of manifolds with headers and a core member connected between the headers. The core member commonly includes a plurality of fluid tubes extending between the manifolds to provide fluid communicating therebetween, a plurality of fins connected to the fluid tubes for enhancing heat exchange, and structural side members connected between the manifolds at the outer sides of the core member.

Heat exchangers commonly use the solid, structural side members and do not address the problem of thermal expansion, and therefore cause stresses on the joints and result in cracking and fatigue thereof.

Another type of heat exchanger is illustrated in U.S. Pat. No. 3,034,770, issued May 15, 1962 in the name of Hiersch. This type of heat exchanger includes a pair of manifolds with a core therebetween. The core comprises a pair of parallel rigid side wall structures interconnecting the manifolds. The side wall structures include a plurality of longitudinal inlet warm-up passages and a plurality of by-pass passages. The warm-up passages openly connect the inlet in one manifold to the by-pass passages of the first and second manifolds. Between the side wall structures is the core comprising a plurality of fluid tubes openly connecting the first manifold to the second manifold. The inlet and outlet are preferably adapted for connection to an oil system under pressure. The oil entering the inlet passes through the intake passage and the warm-up passages to the second manifold. When the oil is cold, the thermal static valve is adapted to open the by-pass passages so that the passages will pass the cold oil from the second manifold directly to the first manifold outlet. When the oil is warm, the thermal static valve is adapted to close the by-pass passage so that oil passes from the second manifold through the core passages in typical heat exchanger manner. Therefore, the patent utilizes the outside passages only when the oil is cool, and thereafter the outside passages are shut off during normal fluid flow and heat exchanger process.

SUMMARY OF THE INVENTION

The invention includes a heat exchanger assembly which comprises a pair of manifolds having openings that convey fluid therethrough and include first and second distal ends. A core member is connected between the pair of manifolds and between the first and second distal ends for conveying fluid between the manifolds through the core member for heat exchange. The core member includes a plurality of fluid tubes extending and connected between the manifolds for communicating fluid, a plurality of fins connected between the fluid tubes for enhancing heat exchange with fluid within the fluid tubes, and structural side support members extending between the manifolds at the distal ends for supporting the fluid tubes and the fins between the side support members and the manifolds. The assembly is characterized by the side support members including fluid passageways therethrough for unrestrictively directing the fluid between the manifolds while concurrently directing the fluid through the fluid tubes to allow the side support members and fluid tubes to be thermally affected by the fluid.

The invention allows the side support members to directly receive the heated fluid and thermally expand with the remainder of the heat exchanger to minimize stresses on the joint connecting each member thereof.

FIGURES IN THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
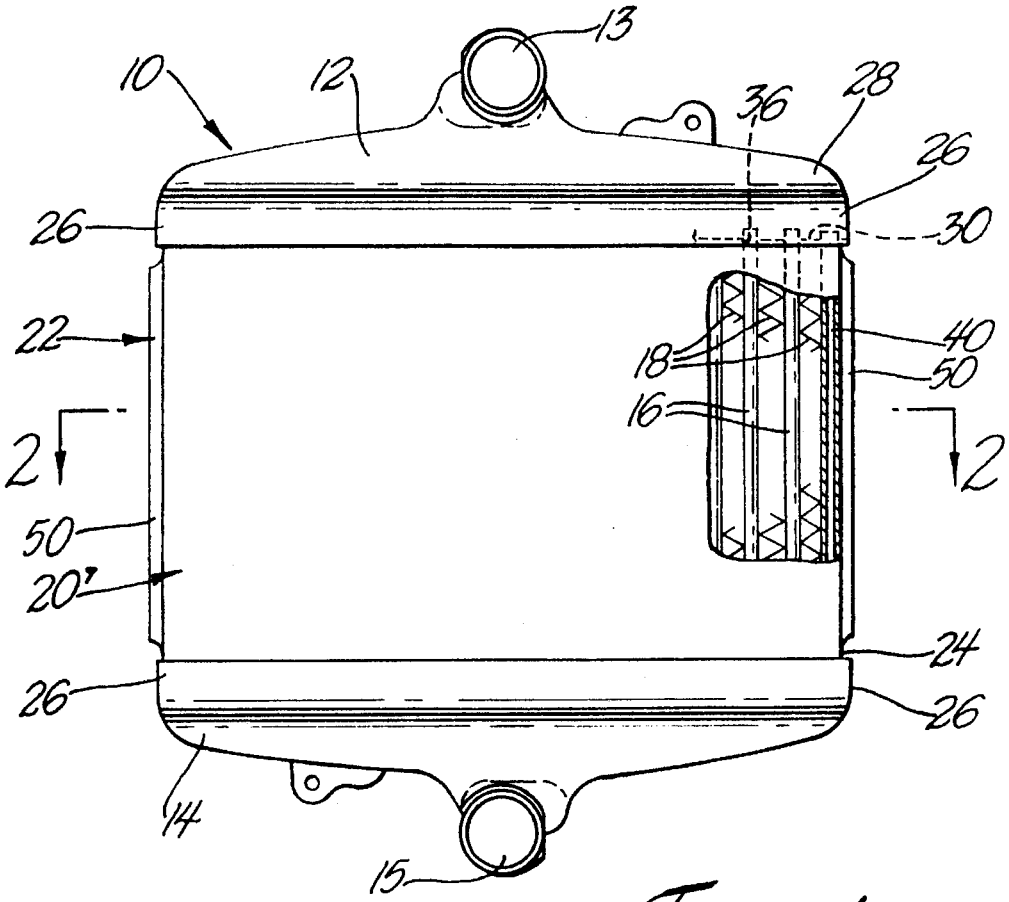
FIG. 1 is a front elevational view of a heat exchanger according to the subject invention.

A heat exchanger assembly of the type commonly used in connection with an automotive vehicle is generally illustrated at 10 in FIG. 1. The heat exchanger assembly 10 comprises upper 12 and lower 14 manifolds providing fluid reservoirs. A core member 20 is connected between the manifolds 12, 14 for conveying fluid from the manifolds 12, 14 through the assembly 10. The core member 20 comprises a plurality of fluid tubes 16 and fins 18. The plurality of fluid tubes 16 extend between the manifolds 12, 14 for communicating a fluid, either a liquid or gas, through the heat exchanger assembly 10. The plurality of external fins 18 extend between adjacent fluid tubes 16 in either air-to-air or liquid-to-air exchangers.

Furthermore, the core member 20 includes a pair of structural side support members 22 extending between the manifolds 12, 14 providing sides 24 of the core member 20 to support the fluid tubes 16 and fins 18 therebetween and further to provide additional interconnection of the core member 20 between the manifolds 12, 14.

In general, as a heated or charged fluid passes through the fluid tube 16, heat is absorbed therefrom by a cooling fluid, preferably ambient air, flowing about the exterior of the fluid tubes 16. The cooling fluid exits from the assembly 10 at a higher temperature due to the exchange of heat with the fluid tubes 16. The "charged" or heated fluid within the tubes 16 is thus cooled to a lower temperature and exits the assembly 10 by way of an outlet 15 in the lower manifold 14. The upper manifold 12 generally includes an inlet 13 for communicating fluid into the assembly 10 from the vehicle engine.

Figure 2:
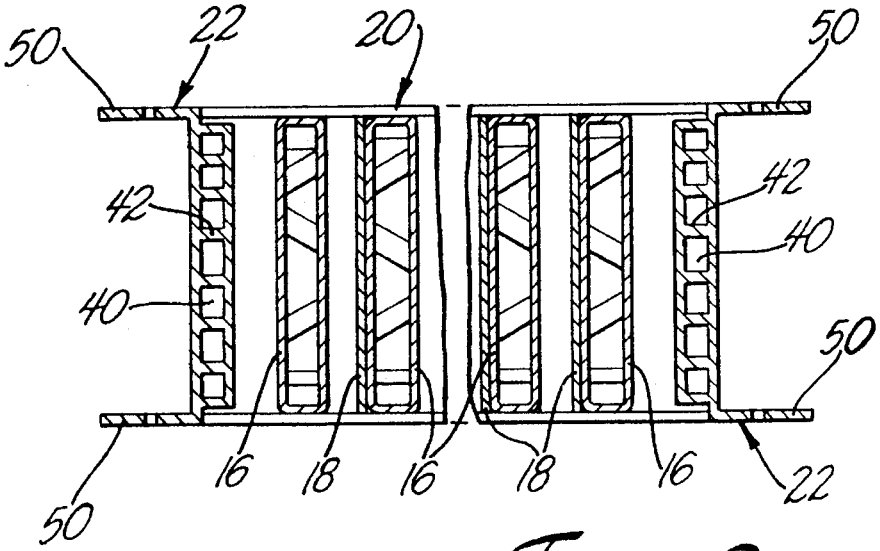
FIG. 2 is a cross-sectional view taken along the lines 2—2 of FIG. 1.

The fluid tubes 16 are comprised of generally flat-sided tubes, oblong in cross-section, as best illustrated in FIG. 2. The fluid tubes 16 may include internal turbulators to increase heat exchange, as commonly known in the art.

The fins 18 are positioned between adjacent fluid tubes 16 for directing the cooling fluid or air about the outer portions of the fluid tubes 16. Such fins 18 generally comprise corrugations of sheet material and are commonly known in the art. In general, the assemblies 10 allow the fluid to circulate through the fluid tubes 16 and manifolds 12, 14 while cool air is passed over the fins 18 and about the tubes 16 to cool the internal fluid medium. The heating of the assembly 10 by the charged fluid and subsequent cooling of the circulating fluid through the hollow fluid tubes 16 results in a large thermal expansion effect on the assembly 10.

More specifically, each of the manifolds 12, 14 includes distal ends 26 at the ends of the longitudinal length of the manifolds 12, 14. The side support members 22 extend adjacent the distal ends of the manifolds 12, 14 and between the manifolds 12, 14.

The manifolds 12, 14 are each comprised of a tank portion 28 and a header portion 30 forming the reservoirs. The tank portion 28 generally includes the inlet opening 13 and/or outlet opening 15 in either of the manifolds 12, 14. This allows the fluids to enter and exit the assembly 10. Furthermore, the header portion 30 comprises a flat, longitudinal member having a plurality of apertures 36 therein for receiving the ends of the fluid tubes 16. In use, it is commonly known that the tank portion 28 is welded or soldered to the header portion 30 to form the manifold 12, 14 with the fluid tubes 16 either soldered or braze sealed to the header portions 30 to provide a unitary assembly 10. The side support members 22 are generally soldered to the outermost fins 18 and welded or soldered to the manifolds 12, 14. Such assembly is commonly known in the art.

The subject invention is directed toward the side support members 22 which are generally comprised of a rigid, structural member longitudinally extending between the distal ends 26 of the manifolds 12, 14 about the exterior sides 24 of the core member 20. The side support members 22 generally provide the only structure support of the core member 20 between the manifolds 12, 14. The side support members 22 include an open and hollow passageway 40 extending therethrough as best illustrated in FIGS. 1 and 2. The hollow passageway 40 is open at both longitudinal ends for freely and unrestrictively communicating fluid between the manifold 12, 14. Extending within the hollow passageway 40 may be provided a plurality of ribs 42 transverse to the fluid flow and extending longitudinally through the passageway 40 to provide additional structural enhancements and provide additional heat transfer. The width of the passageways 40 are substantially similar to and may be slightly less than the width of the fluid tubes 16. The side support members 22 are generally welded at points to the header portions 30 at both ends and are soldered or braze sealed to the external fins 18 of the core member 20. The hollow side support members 22 allows the fluid medium to circulate therethrough from the upper manifolds 12 to the lower manifolds 14, or intake manifold 12 to outlet manifold 14o By allowing fluid to pass through the side support members 22 in addition to and concurrent with the normal fluid flow through the fluid tubes 16, uniform thermal expansion of the assembly 10 and core member 20 may occur which reduces sheer stresses that can cause fatigue or failing of the heat exchanger 10 and other heat transfer characteristics. The side support members 22 receive the same thermal changes and effects from the fluid as do the fluid tubes 16, and can therefor similarly expand, reducing stresses on the joints.

Figure 3:
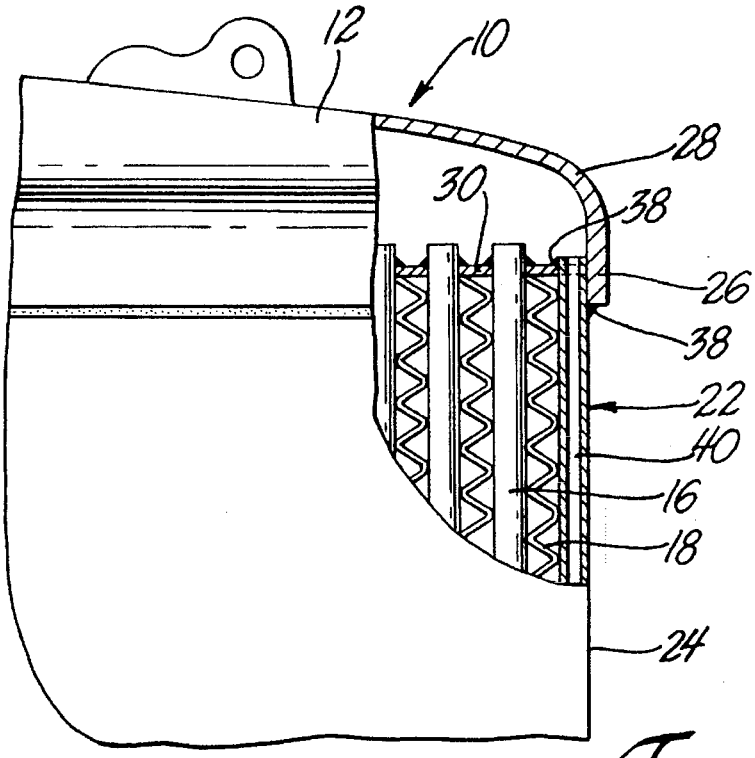
FIG. 3 is an enlarged, partially broken away view of the upper right hand corner of the heat exchanger of FIG. 1 showing a first embodiment.

There are two embodiments 10, 10' of the connection of the side support members 22 to the manifolds 12, 14. As illustrated in FIG. 3, a first embodiment includes the header portions 30 spaced from the tank portions 28 to receive the ends of the side support members 22 therein. This allows soldering or welding of the side support members 22 to both the tank portions 28 and header portions 30 at joints 38. Fluid freely flows between the manifolds 12, 14 through the side support members 22 through the passageway 40. In this embodiment, the distal ends 26 of the tank portions 28 curve and extend beyond the header portion 30 and planar with or parallel with the side support members 22 to allow a secure welded joint or connection thereto. The end of the header portion 30 abuts against the side support member 22 in a perpendicular manner and is welded thereto.

Figure 4:
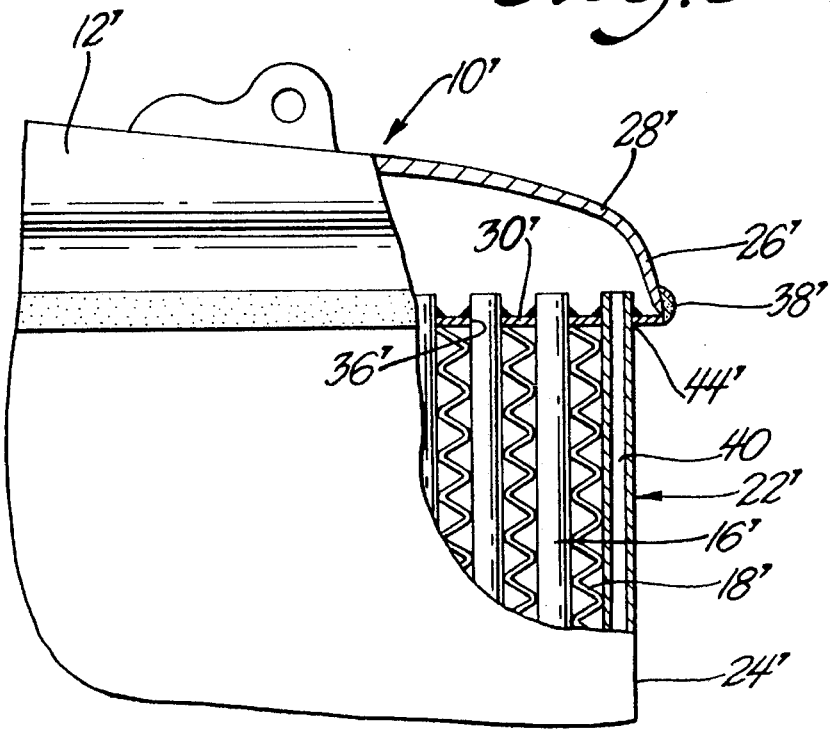
FIG. 4 is an enlarged partially broken away view of the upper right hand corner of the heat exchanger of FIG. 1 showing a second embodiment.

The second embodiment 10' is illustrated in FIG. 4 wherein primed reference numerals are used to indicate like parts of the first embodiment 10. The header portions 30' includes a pair of side apertures 44' at both ends thereof in addition to the apertures 36' receiving the fluid tubes 16. The side apertures 44' are configured and sized to receive the side support members 22' therein. In this embodiment, the header portion 30' extends out to and in contact with the tank portion 28' at the distal ends for soldering or welding thereagainst at joints 38'. In this embodiment, the side support members 22' provide direct support only at the header portions 30' by connection between the support members 22' and headers 30' at a welded joint.

In either of the embodiments 10, 10', the side support members 22, 22' may optionally include flanges 50 (FIGS. 1 and 2) extending therefrom to allow mounting of the heat exchanger 10 to a vehicle. It is to be understood that any other alternative design of the side support members 22 may be included so long at the hollow passageway 40 is provided within the structural side support members 22.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. A heat exchanger assembly (10) comprising:

a pair of manifolds (12, 14) having openings (13, 15) to convey fluid therethrough and including first and second distal ends (26);

a core member (20) connected between said pair of manifolds (12, 14) and between said first and second distal ends (26) for conveying fluid between said manifolds (12, 14) through said core member (20) for heat exchange;

said core member (20) including a plurality of fluid tubes (16) extending and connected between said manifolds for communicating fluid, a plurality of fins (18) connected between said fluid tubes (16) for enhancing heat exchange with fluid within said fluid tubes (16), and structural side support members (22) extending between said manifolds (12, 14) at said distal ends (26) for supporting said fluid tubes (16) and said fins (18) between said side support members (22) and said manifolds (12, 14);

said side support members (22) including fluid passageways (40) therethrough for unrestrictively communicating the fluid between said manifolds (12, 14) while concurrently directing the fluid through said fluid tubes (16) to allow said side support members (22) and said fluid tube (16) to be uniformly thermally affected by the fluid;

said pair of manifolds (12, 14) including a single inlet opening (13) and a single outlet opening (15) for providing flow of fluid into and out of said assembly (10);

said manifolds (12, 14) including tank portions (28) having said inlet and outlet openings (13, 15) and header portions (30) connected to said tank portions (28) to form said manifolds (12, 14), said header portions (30) including a plurality of apertures (36) therein for receiving said fluid tubes (16) in connection therewith, and characterized by said header portions (30) spaced from said tank portions (28) at said distal ends for receiving said side support members (22) therebetween for communication of the fluid between said manifolds (12, 14).

* * * * *